US005598885A

United States Patent [19]

Meroni et al.

[11] Patent Number: 5,598,885

[45] Date of Patent: Feb. 4, 1997

[54] METHOD FOR THE CONTINUOUS CASTING OF HIGH-CARBON STEELS

[75] Inventors: Umberto Meroni; Domenico W. Ruzza, both of Udine; Andrea Carboni, Milano, all of Italy

[73] Assignee: Danieli & C. Officine Meccaniche SpA, Buttrio, Italy

[21] Appl. No.: 452,538

[22] Filed: May 30, 1995

[30] Foreign Application Priority Data

May 30, 1994 [IT] Italy ..... UD94A0091

[51] Int. Cl.[6] ..... B22D 11/00; B22D 11/04

[52] U.S. Cl. ..... 164/478; 164/459

[58] Field of Search ..... 164/478, 416, 164/459, 418, 483

[56] References Cited

U.S. PATENT DOCUMENTS

| | | | |
|---|---|---|---|
| 5,460,220 | 10/1995 | Coassin | 164/418 |
| 5,469,910 | 11/1995 | Kawa et al. | 164/418 |

FOREIGN PATENT DOCUMENTS

| | | | |
|---|---|---|---|
| 498296 | 1/1992 | European Pat. Off. . | |
| 3427756 | 2/1985 | Germany . | |
| 58-38646 | 3/1983 | Japan | 164/478 |
| 604619 | 4/1978 | U.S.S.R. | 164/416 |

OTHER PUBLICATIONS

R. B. Mahapatra et al "Mold Behavior and Its Influence on Quality In THe Continuous Casting of Steel Slaps Part I" pp. 861–874.

R. B. Mahapatra et al "Mold Behavior and Its Influence on Quality in Continuous Casting of Steel Slaps II" pp. 875–888 Dec. 1991.

Patent Abstracts of Japan vol. 16, No. 388 (M–1297) Aug. 18, 1992 & JP A 04 127 948 (Sumitomo Metal Ind. Ltd) 28 Apr. 1992.

*Primary Examiner*—Kuang Y. Lin

*Attorney, Agent, or Firm*—Antonelli, Terry, Stout & Kraus, LLP

[57] ABSTRACT

Method for the continuous casting of high-carbon steels to produce thin slabs, these steels being characterised by a content of carbon greater than 0.50%, in which method the taper of the mould at least in its first segment having to be between 1.5% and 4% per meter, the frequency of oscillation of the mould being between 180 and 350 oscillations per minute with a travel upwards and downwards of about ±5 to 9 mm., with a total travel of 10 to 18 mm., the cooling in the primary cooling period being very intense, the times of the transient state of start-up of the casting being reduced by ⅓ to ¼ as compared to the normal times of the transient state of start-up.

10 Claims, 1 Drawing Sheet

METHOD FOR THE CONTINUOUS CASTING OF HIGH-CARBON STEELS

BACKGROUND OF THE INVENTION

This invention concerns a method for the continuous casting of high-carbon steels.

By high-carbon steels are meant steels with a carbon content greater than 0.50%.

The method of this invention is applied to the field of the production by continuous casting of thin slabs of special steels having high mechanical and technological properties.

By thin slabs are meant slabs with a thickness less than 90 to 95 mm. and a width between 800 and 2500 to 3000 mm.

The method according to the invention has the purpose of perfecting the structural and technological characteristics with a view to adapting the continuous casting machine to the metallurgical properties which such special steels possess.

High-carbon steels, which are defined as steels having a carbon content of at least 0.50%, possess some metallurgical characteristics which are derived specifically from their composition and which make very delicate the continuous casting process if it is desired to obtain satisfactory qualitative results.

Such high-carbon steels, contrary to low-carbon steels such as peritectic steels for instance, are characterised by a low tendency towards shrinkage and contraction during their solidification step.

These high-carbon steels therefore do not entail problems of formation of depressions or of separation from the copper walls of the mould.

On the contrary, they are characterised by a strong tendency towards adherence, that is to say, adherence between the solidifying skin and the copper walls of the mould; this adherence leads to the stoppage of the casting process.

Moreover, such steels have a high speed of solidification in the mould, and this situation can cause wedge-shaped formations in the casting chamber of the mould if the transient state of start-up of the casting is carried out too slowly.

The article "Gallatin Steel follow thin slab route" in the Trade Journal "Iron and Steel International" of 1994 states clearly on page 55 and the following pages that no one has so far been able to cast high-carbon steels continuously; the table given on page 57 also shows clearly the absence of such types of steels with a carbon content greater than 0.50%.

At the Conference held in Peking in September 1993 a report entitled "Near-Net-Shape-Casting" was presented which was shown on page 391 and the following pages of the documents of the Conference.

That report indicates what was confirmed thereafter in the aforesaid article in the "Iron and Steel International".

This shows that technicians have been seeking for a long time a method suitable to cast continuously, and advantageously in the form of thin slabs, high-carbon steels, but without yet having succeeded.

DESCRIPTION OF THE INVENTION

The present applicants have designed, tested and obtained this invention to overcome these and other problems which have prevented high-carbon steels from being cast, and also to achieve further advantages.

The purpose of this invention is to obtain a continuous casting method able to cast thin slabs of high-carbon steels.

According to the invention a crystalliser, of which the tapered sidewalls are characterised by a reduced taper, is provided to prevent the strong tendency of these steels towards adherence between the solidifying skin of the slabs and the copper sidewalls of the mould.

The taper of the mould is defined by the converging arrangement of the narrow sidewalls of the crystalliser from the inlet to the outlet of the crystalliser.

Analytically, by taper of the mould is meant the value of $[(1_A-1_B)/(1_B \times hi)] \times 100$, in which hi is the height of the segment of mould of which it is desired to determine the taper, $1_A$ is the effective width at the inlet of the segment having the height hi with account being taken of the development determined by any casting chamber, and $1_B$ is the width at the outlet of the segment having the height hi with account being taken of the development determined by the casting chamber.

Figure 2A:
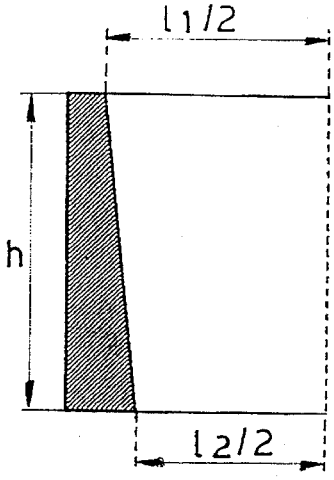
FIGS. 2*a*–2*c* show various tapers of molds.
Figure 2B:
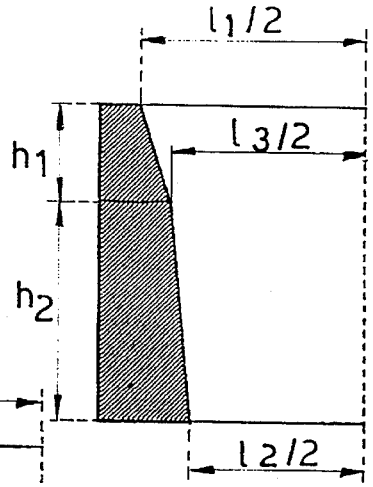
Figure 2C:
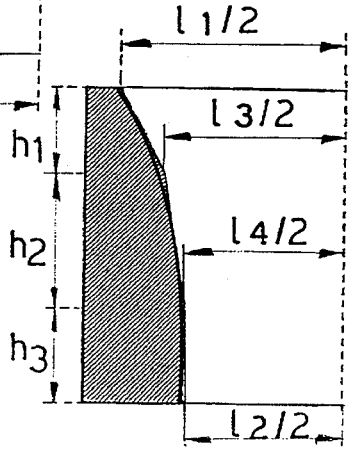

As can be seen in the attached FIGS. 2*a*, 2*b* and 2*c* the taper of the mould may be of a single type (FIG. 2*a*), of a double type (FIG. 2*b*), of a triple type (FIG. 2*c*), or of a multiple type or may also be defined by a continuous curve obtained by interpolation of a plurality of consecutive segments having different tape as is shown in FIG. 2*c*.

It has been found by experiments that in casting high-carbon steels it is advantageous to use a mould having at east a double or triple taper.

In order to obtain a correct formation of the skin, the initial segment of the mould plays a special part and, according to the invention, should have a value of taper defined in this case by $[(1_1-1_3)/(1_3 \times h1)] \times 100$ and ranging between 1.5%/m. and 4%/m.

Exact relationships may also be determined between the differing tapers of the different consecutive segments defined by the variation of taper of the mould.

The oscillation of the mould, by reason of the above tendency towards adherence of skin to the sidewalls, has to be characterised according to the invention by an ample travel and a low frequency.

As an example, values found by experiments to be advantageous are a travel of about ± 5 to 9 mm. upwards and downwards, with a total travel between 10 and 18 mm., and a frequency of about 180 to 350 oscillations per minute.

Moreover, the frequency of oscillation has to be altered according to the casting speed in such a way that the negative strip time remains substantially constant; by negative strip time is meant that time during the period of the oscillation in which the mould descends at a speed greater than the speed of the cast slab. This time has a considerable influence on the lubrication.

It has been found by experiments that the best negative strip time for high-carbon steels is in the range between 0.09 and 0.12 seconds, but advantageously between 0.10 and 0.11 seconds.

According to the invention it is advantageous to maintain a great heat exchange within the mould.

For this reason it is convenient to employ a high speed of the cooling water in the primary cooling period, that is to say, in the mould, this speed being about 5.5 to 7.5 metres per second for crystallisers suitable to produce thin slabs.

According to the invention it is also necessary to employ lubricating powders with a low basicity of about 0.9, which do not restrict the thermal flow.

Furthermore, it is advantageous to use high values of difference of temperature, that is to say, the difference between the temperature of the liquid steel measured in the tundish immediately before and during the casting and the temperature at the beginning of solidification of the steel, for this also assists melting of/the lubricating powders.

The values of this difference of temperature are about 12° to 35° C., but advantageously between 15° and 25° C. Besides, according to the invention it is necessary to accelerate the transient state of start-up of the casting for the purpose of avoiding, wedge-shaped formations of the slab in the casting chamber of the mould, such formations being due to the quick solidification of the high-carbon steel in the mould.

As an example, the transient state of start-up of the casting has to be reduced by ⅓ to ¼ as compared to the normal transient state; as an example it has to be reduced to about 30 seconds as compared to the 45 seconds of the conventional transient state for slabs having a thickness of about 60 mm.

Figure 1:
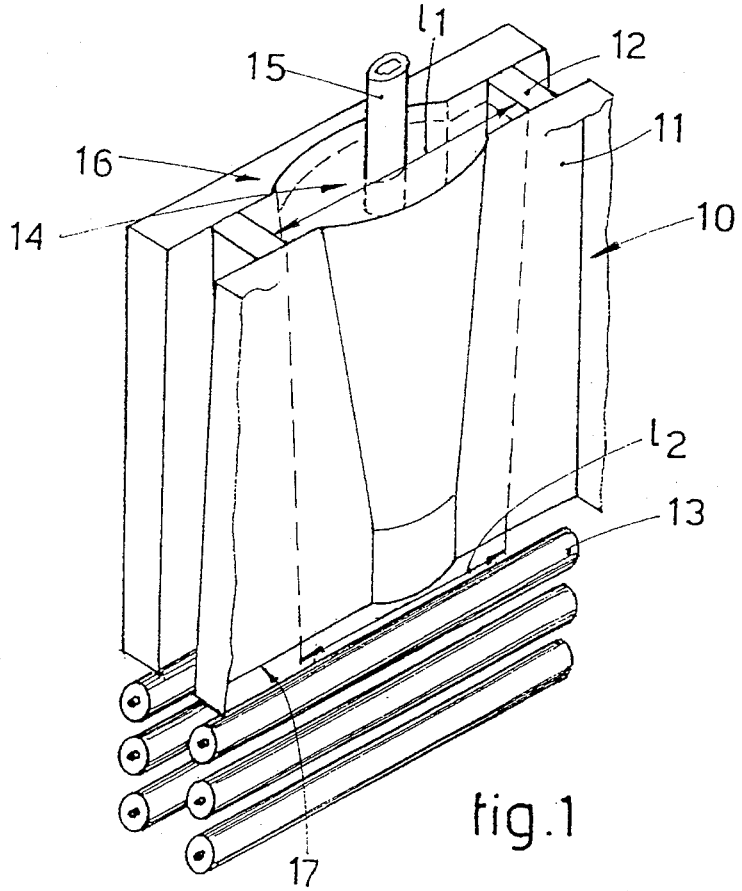
FIG. 1 is a schematic view of a crystalliser employed to test the parameters of the method of the present invention.

The attached FIG. 1 shows merely as an example the configuration of the crystalliser 10 employed to test all the parameters of the method according to the invention.

If the type of crystalliser is changed, some parameters may be varied.

The mould 10 has long sidewalls 11 and narrow sidewalls 12, which are possibly movable, and includes a through central casting chamber 14 for the introduction of a discharge nozzle 15.

The inlet and outlet cross-sections of the mould 10 are referenced with 16 and 17 respectively.

Soft-reduction rolls 13 are included in cooperation with the outlet 17.

In this case, the taper of the mould as defined above takes on a value between 1.5%/m. and 4%/m. at least in the first segment of the mould.

We claim:

1. Method for the continuous casting of high-carbon steels having a carbon content greater than 0.50% to produce thin slabs, comprising continuously casting the high-carbon steel through a mold having a taper at least in its first segment between 1.5% and 4% per meter while oscillating the mold, the frequency of oscillation of the mold being between 180 and 350 oscillations per minute with a travel upwards and downwards of about ± 5 to 9 mm. and with a total travel of 10 to 18 mm., and very intensely cooling in a primary cooling period, wherein a time of transient state of start-up of the casting is reduced by ⅓ to ¼ as compared to a normal time of transient state of start-up.

2. Method as in claim 1, in which the taper of the mold is variable and is at least of a triple type.

3. Method as in claim 1, in which the time of the transient state start-up of the casting is about 30 seconds and the thin slab has a thickness of about 60 mm.

4. Method as in claim 1, in which the taper of the mold is variable and is at least of a double type (FIG. 2*b*).

5. Method as in claim 1, in which the taper of the mold is variable and is defined by a continuous curve obtained by interpolation of a plurality of consecutive segments having different tapers.

6. Method as in claim 1, in which the frequency of oscillation is linked to the casting speed so as to maintain the negative strip time, upon variation of the casting speed, constantly in a range between 0.09 and 0.12 seconds, the negative strip time being defined as the time, in the period of oscillation, in which the mould descends at a speed greater than that of the cast slab.

7. Method as in claim 1, further comprising adding lubrication powders to the mold, the lubrication powders having a low basicity of about 0.9.

8. Method as in claim 1, in which the difference of temperature is about 12° to 35° C., the difference of temperature being defined as the difference between the temperature of the liquid steel measured in the tundish immediately before and during the casting and the temperature of the beginning of solidification of the steel.

9. Method as in claim 8, in which the difference of temperature is about 15° to 25° C.

10. Method as in claim 6, wherein the negative strip time is controlled to be in a range between 0.10 and 0.11 seconds.

* * * * *